United States Patent [19]

Takeda et al.

[11] Patent Number: 4,673,902

[45] Date of Patent: Jun. 16, 1987

[54] DIELECTRIC MATERIAL COAXIAL RESONATOR FILTER DIRECTLY MOUNTABLE ON A CIRCUIT BOARD

[75] Inventors: Tomoyuki Takeda, Nagaokakyo; Yoji Ito, Takatsuki, both of Japan

[73] Assignee: Murata Manufacturing Co., Ltd., Japan

[21] Appl. No.: 671,741

[22] Filed: Nov. 15, 1984

[30] Foreign Application Priority Data

Nov. 25, 1983 [JP] Japan ..... 58-222864

[51] Int. Cl.[4] ..... H01P 2/03

[52] U.S. Cl. ..... 333/202; 333/204; 333/206; 333/222

[58] Field of Search ..... 333/202, 204, 205, 206, 333/207, 222–226

[56] References Cited

U.S. PATENT DOCUMENTS

| | | | |
|---|---|---|---|
| 2,163,625 | 6/1939 | Peterson | 333/206 |
| 4,426,631 | 1/1984 | D'Avello | 333/202 |
| 4,431,977 | 2/1984 | Sakola et al. | 333/206 |
| 4,434,410 | 2/1984 | Miyake et al. | 333/207 X |
| 4,464,640 | 8/1984 | Nishikawa et al. | 333/206 X |

FOREIGN PATENT DOCUMENTS

| | | | |
|---|---|---|---|
| 0152704 | 9/1982 | Japan | 333/222 |
| 0108801 | 6/1983 | Japan | 333/207 |
| 0114603 | 7/1983 | Japan | 333/204 |
| 0213503 | 12/1983 | Japan | 333/202 |
| 0114901 | 7/1984 | Japan | 333/202 |
| 0052601 | 4/1986 | Japan | 333/206 |

*Primary Examiner*—Eugene R. LaRoche
*Assistant Examiner*—Benny T. Lee
*Attorney, Agent, or Firm*—Ostrolenk, Faber, Gerb & Soffen

[57] ABSTRACT

A dielectric material coaxial resonator which includes at least one dielectric material block member having a through-opening axially formed in it in one direction, an inner conductive layer formed on an inner peripheral surface of the through-opening, an outer conductive layer formed on an outer wall surface of the dielectric material block member, an open end face which is provided on at least one end face of the dielectric material block member where the through-opening is opened and at which an outer surface of the dielectric material block member is exposed, and capacitor electrodes formed on the open end face so as to constitute a single resonator unit.

21 Claims, 15 Drawing Figures

DIELECTRIC MATERIAL COAXIAL RESONATOR FILTER DIRECTLY MOUNTABLE ON A CIRCUIT BOARD

BACKGROUND OF THE INVENTION

The present invention generally relates to a coaxial resonator and more particularly, to a dielectric material coaxial resonator mainly employed for filter elements and the like of an electrical filter device.

A conventional dielectric coaxial resonator of the above described type is shown in FIG. 1. This resonator intended to be used for a filter element of a ¼ wavelength two stage electrical filter device, and includes first and second single resonator units Ra and Rb of the same construction aligned laterally side by side so as to be molded into one unit.

Each resonator unit Ra, Rb includes a respective dielectric material block Da, Db formed of a ceramic material or the like in the shape of a rectangular parralelepiped having a through-bore Ha, of a circular cross section formed at central portions thereof. Inner conductive layers or inner conductors Ea, Eb, respective are formed over the inner peripheral surfaces of the through-holes Ha, Hb. An outer conductive layer or outer conductor Ec is formed over the outer peripheral surfaces of the dielectric material blocks Da, Db, and an electrode Es is formed on one end face i.e. lower end face F1 in FIG. 1 to short-circuit the outer conductor Ec with the inner conductors Ea and Eb. The other end face i.e. upper end face F2 in FIG. 1 is formed as an open end face so that the outer faces of the dielectric material blocks Da and Db are exposed. In the actual structure, the dielectric material blocks Da and Db for the first and second single resonator units Ra and Rb are molded in the form of one block, with a coupling degree adjusting bore V, for example, of rectangular cross section, being formed at a central portion between said resonator units Ra and Rb. Moreover, in the through-bores Ha and Hb of the resonator units Ra and Rb, electrically insulative bushings Ba and Bb in which input and output pin terminals Pa and Pb are fitted under pressure, are respectively inserted. These bushings Ba and Bb serve to support the pin terminals Pa and Pb, and also to achieve a coupling electrostatic capacity (referred to merely as a coupling capacity hereinbelow) between the inner conductors Ea and Eb, and the pin terminals Pa and Pb.

In the conventional resonator having the construction described above, when a high frequency signal is applied, for example, to the pin terminal Pa of the first resonator unit Ra, said signal is applied from the inner conductor Ea to the first resonator unit Ra through the coupling capacity produced between the pin terminal Pa and the first inner conductor Ea. Subsequently, the above signal is propagated to the second resonator unit Rb which is magnetically coupled with the first resonator unit Ra through the coupling degree adjusting hole V, and is then fed to the second pin terminal, i.e. output side pin terminal Pb from the inner conductor Eb through the coupling capacity produced between the second inner conductor Eb and second pin terminal Pb. The known resonator is accommodated in a metallic casing (not shown) through a spring means (not shown) in an electrically conducted state so as to function as a filter device.

However, in the conventional coaxial resonator as described above, it is impossible to mount the single resonator units Ra and Rb themselves directly onto a printed substrate or printed circuit board of electronic equipment, thus requiring the use of the input and output pin terminals Pa and Pb and bushings Ba and Bb, etc. for this purpose, while in the case where the resonator is used as a filter device, the metallic casing for accommodating the resonator therein and spring members, etc. are separately required, inevitably resulting in an increase in the number of parts involved and complication of assembling work and making it impossible to achieve reduction in the material cost and manufacturing cost. Such disadvantages as described above become more conspicuous especially as the number of stages of a multi-stage type filter is increased.

Furthermore, the bushings Ba and Bb are normally molded from a synthetic resin material which cannot normally withstand high temperatures, and are not reliable in that the material becomes unstable in its characteristics or is subjected to fatigue or breakage in a short period under circumstances where temperature variation is excessive.

The problems as explained above are not limited to the multi-stage type coaxial resonators represented by the two stage type coaxial resonator described above, but similarly occur in an arrangement including only a single resonator unit.

SUMMARY OF THE INVENTION

Accordingly, an essential object of the present invention is to provide an improved dielectric material coaxial resonator in which a single resonator unit is adapted to be capable of functioning independently as a filter device, so that it can be directly attached onto a printed circuit board or the like of an electronic equipment, thus achieving reduction in the material cost and assembling cost through omission of conventionally required parts such as pin terminals, metallic casing, springs, etc., with simultaneous improvements on the workability for assembling and reliability during use, and which is characterized in that a capacitor electrode is formed on an open end face of a dielectric material block for the coaxial resonator.

Another important object of the present invention is to provide a dielectric material coaxial resonator of the above described type in which the single resonator units having features as described above are coupled to each other through a coupling means so as to provide a coaxial resonator of a multi-stage type.

In accomplishing these and other objects, according to one preferred embodiment of the present invention, there is provided a dielectric material coaxial resonator which includes at least one dielectric material block member having a through-opening axially formed therein in one direction, an inner conductive layer formed on an inner peripheral surface of the through-opening, an outer conductive layer formed on an outer wall surface of the dielectric material block member, and another conductive layer formed on one end face of the dielectric material member as a short-circuited end face for conduction between the inner and outer conductive layers, an open end face which is provided on the other end face of the dielectric material block member remote from the short-circuited end face thereof, and at which the through-opening is opened, with an outer surface of the dielectric material block member being exposed thereat, and capacitor electrodes formed on the open end face for producing coupling capacity, thereby constituting a single resonator unit.

By the arrangement according to the present invention as described above, an improved dielectric material coaxial resonator has been advantageously presented through a simple construction.

BRIEF DESCRIPTION OF THE DRAWINGS

These and other objects and features of the present invention will become apparent from the following description of a preferred embodiment thereof with reference to the accompanying drawings, in which.

BRIEF DESCRIPTION OF THE INVENTION

Figure 1:
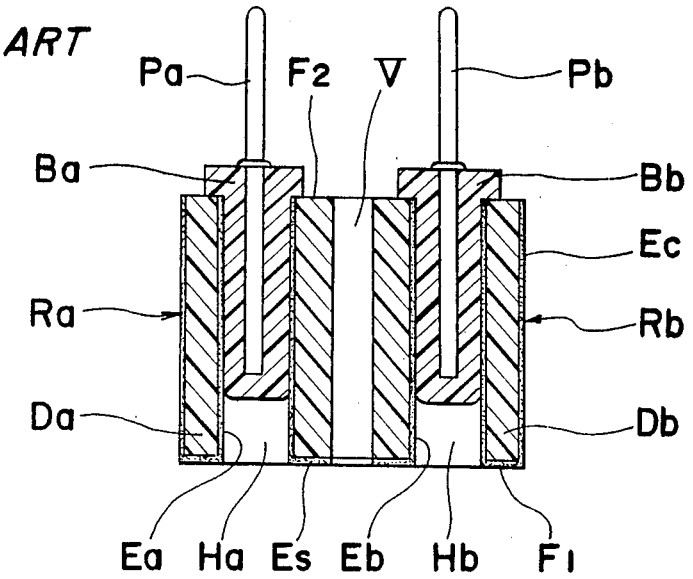
Fig. 1 PRIOR ART
FIG. 1 is a side sectional view of a conventional dielectric material coaxial resonator (already referred to)

Before the description of the present invention proceeds, it is to be noted that like parts are designated by like reference numerals throughout the accompanying drawings.

Referring now to the drawings, there is shown in FIGS. 2 through 5, a dielectric material coaxial resonator RA according to one preferred embodiment of the present invention. The coaxial resonator RA of a so-called two stage type in which single resonator units 1*a* and 1*b* of a $\frac{1}{4}$ wavelength type and of the same specification are magnetically coupled to each other, is constituted by molding into one unit, the first and second single resonator units 1*a* and 1*b* laterally aligned with each other side by side. The first single resonator unit 1*a* fundamentally includes a dielectric material block 2*a* of a ceramic material or the like in the form of a rectangular parallelepiped formed, at its central portion, with a through-bore or through-opening 3*a* of a circular cross section, an inner conductive layer or inner conductor 4*a* formed over the inner peripheral surface of the through-bore 3*a*, an outer conductive layer or outer conductor 5 formed over the outer surface of the dielectric material block 2*a*, and an electrode or another conductive layer 6 formed on one end face 7 of the block 2*a* for electrically short-circuiting the outer conductor 5 with the inner conductor 4*a*, with the other end face of the block 2*a* being an open end face 8. According to one feature of the present invention, there is further formed a capacitor electrode 9*a* on the open end face 8 as described hereinbelow.

Figure 3:
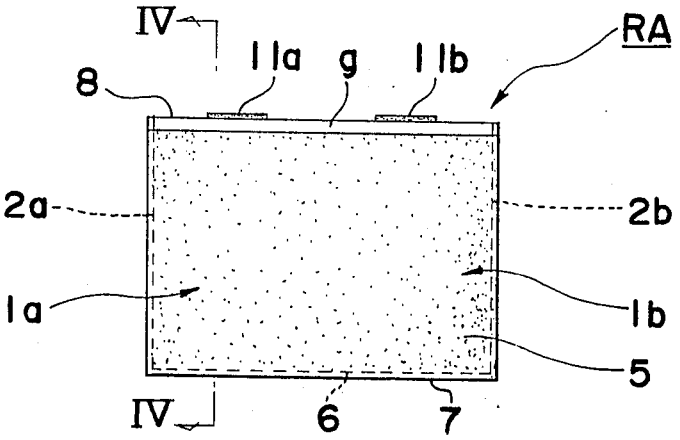
FIG. 3 is a side elevational view of the coaxial resonator of FIG. 2.
Figure 4:
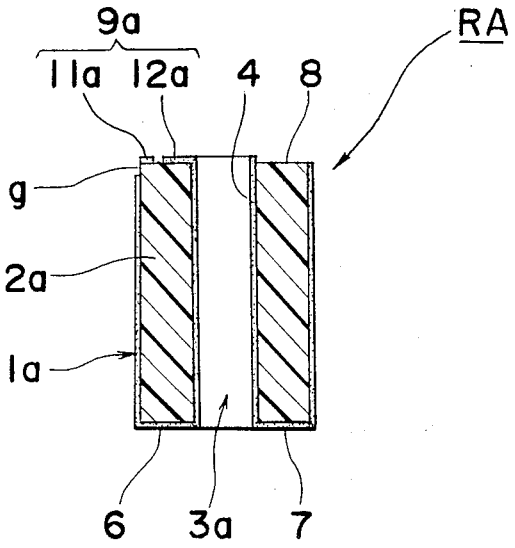
FIG. 4 is a cross section taken along the line IV—IV in FIG. 3.

The capacitor electrode 9*a* includes a generally U-shaped equipment connecting side electrode 11*a* having a connecting edge aligned with one side of the open end face 8, and a convex electrode 12*a* connected with the inner conductive layer 4*a* and provided to confront the U-shaped electrode 11*a* through a predetermined interval, thereby to achieve a required coupling capacity between the electrodes 11*a* and 12*a*. Between the equipment connecting side electrode 11*a* and the outer conductive layer 5, there is provided a ground fault prevention gap g in which no conductive layer is formed on the dielectric material block (FIGS. 3 and 4). The capacitor electrode 9*a* having the construction described above is constituted, for example, in such a manner that, after plating an electrode material such as silver, copper or the like on the open end face 8, the electrodes 11*a* and 12*a* are formed by an etching process. In other electrode forming systems, patterns of the electrodes 11*a* and 12*a* are first printed on the open end face 8 so as to be subsequently baked thereonto for the formation of said electrodes or an electrode layer is once printed over the entire open end face 8 so as to be subsequently subjected to a baking finish, and thereafter, etching is effected to leave the patterns of the electrodes 11*a* and 12*a*.

The second single resonator unit 1*b* is of the same specification or construction as the first single resonator unit 1*a*, and includes a dielectric material block 2*b* formed with a through-bore 3*b* at its central portion, an inner conductive layer 4*b* formed over the inner peripheral surface of the through-bore 3*b*, and a capacitor electrode 9*b* including a U-shaped electrode 11*b* and a corresponding convex electrode 12*b* formed in the similar manner as in the capacitor electrode 9*a* for the first resonator unit 1*a*. In the preferred actual construction, however, the dielectric material blocks 2*a* and 2*b* for the first and second single resonator units 1*a* and 1*b* are integrally formed into one block, with the outer conductor 5 and the short-circuiting electrode 6 being adapted to be commonly used for both of the resonator units 1*a* and 1*b*, with a coupling degree adjusting bore 13 (coupling means) having, for example, a rectangular cross section, being provided at an intermediate portion between said single resonator units 1*a* and 1*b* to extend through said dielectric material block.

Figure 5:
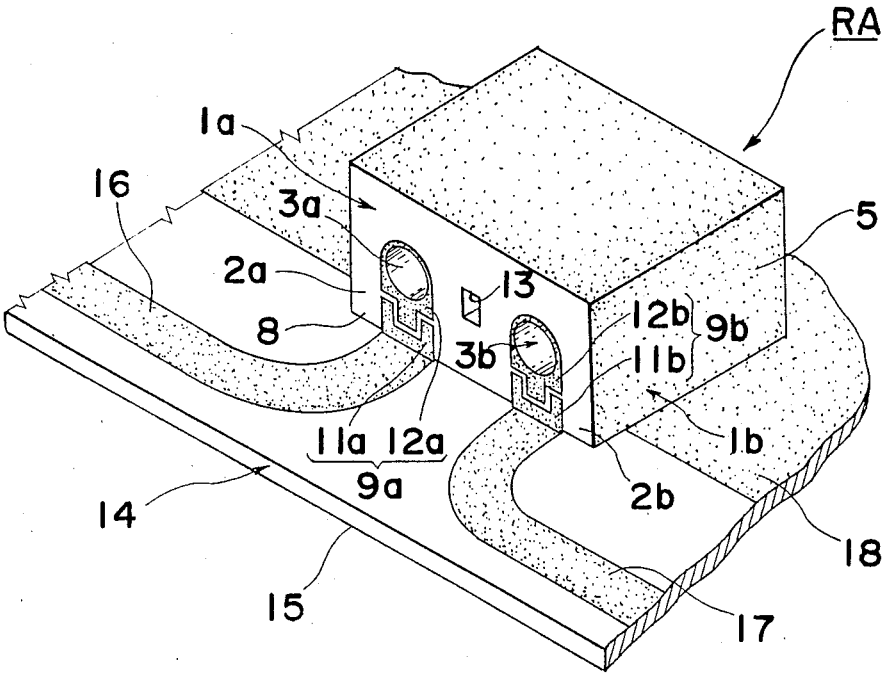
FIG. 5 is a perspective view showing one example of use of the coaxial resonator of FIG. 2, FIGS. 6(*a*) to 6(*d*) are views similar to FIG. 2, which particularly show modifications of the capacitor electrodes employed in the coaxial resonator of FIG. 2.
Figure 6A:
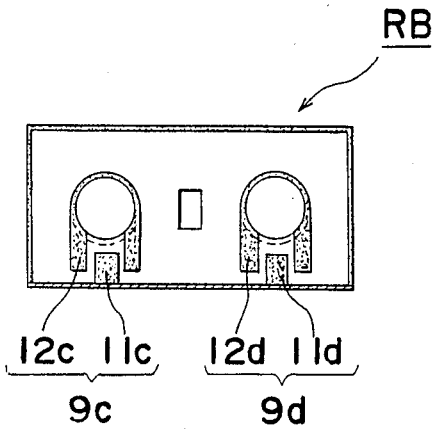
Figure 6B:
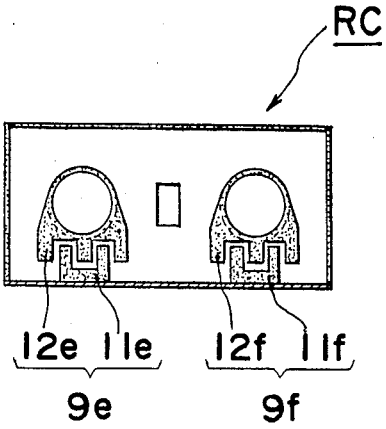
Figure 6C:
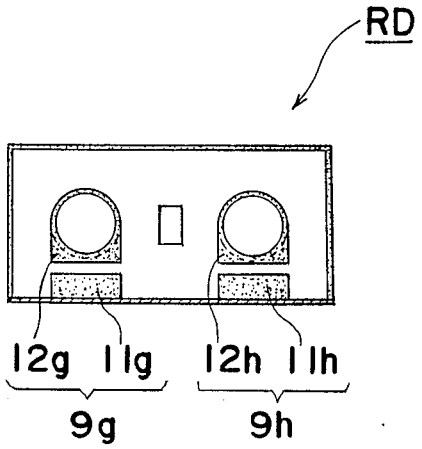
Figure 6D:
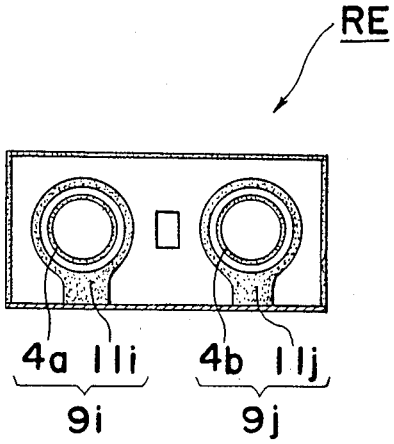

Referring particularly to FIG. 5, the resonator RA having the construction as described above may be mounted on a printed circuit board 14 forming part of an electronic apparatus (not particularly shown). The printed circuit board 14 made, for example, of epoxy glass, ceramics, etc. has input and output side strip lines 16 and 17 and a grounding electrode 18 on its front surface, and a grounding electrode 15 on its reverse surface.

The resonator RA is disposed on the front surface of said printed circuit board 14, and the equipment connecting side electrode 11*a* of the first single resonator unit 1*a* is connected to the input side strip line 16, while the equipment connecting side electrode 11*b* of the second single resonator unit 1*b* is connected to the output side strip line 17, with the outer conductor 5 of the resonator RA being connected to the grounding electrode 18. For the above connections, soldering, connection by an electrically conductive paste and the like are normally employed.

In the resonator RA fixedly disposed on the printed circuit board 14 as described above, when a high frequency signal is applied, for example, from the input side strip line 16 to the first equipment connecting side electrode 11*a* of the resonator RA, said signal is imparted from the first inner conductor 4*a* of the first single resonator unit 1*a* through a coupling capacity produced at the first capacitor electrode 9*a*. Subsequently, the above signal is fed to the second single resonator unit 1*b* which is magnetically coupled with the first single resonator unit 1*a* through the coupling degree adjusting bore 13, and thereafter, is propagated to the output side strip line 17 from the second inner conductor 4*b* through a coupling capacity produced in the second capacitor electrode 9*b*.

Figure 2:
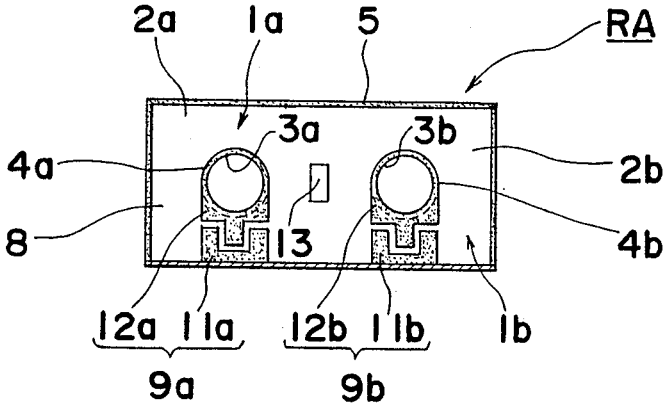
FIG. 2 is a top plan view of a dielectric material coaxial resonator according to one preferred embodiment of the present invention.

Referring further to FIGS. 6(*a*) through 6(*d*), there are shown modifications of the capacitor electrodes 9*a* and 9*b* in the resonator RA of FIGS. 2 to 5. In these modifications, the dimensions at the confronting portions between the equipment connecting side electrodes 11 and the electrodes 12 at the inner conductor side, and configurations and positional relation of the electrodes 11 and 12, are altered in various ways according to the required electrostatic capacity. In the capacitor electrodes 9*c* and 9*d*, and 9*e* and 9*f* of the coaxial resonators RB and RC in FIGS. 6(*a*) and 6(*b*), the inner conductor side electrodes 12*c* and 12*d*, and 12*e* and 12*f* are closely combined alternately with the equipment connecting side electrodes 11*c* and 11*d*, and 11*e* and 11*f*. In the coaxial resonator RC in FIG. 6(*b*), the electrodes 12*e* and 11*e* for the capacitor electrode 9*e*, and the electrodes 12*f* and 11*f* for the capacitor electrode 9*f* are formed into comb-like patterns to achieve a larger coupling capacitance than in the coaxial resonator RB in FIG. 6(*a*). In the capacitor electrodes 9*g* and 9*h* for the coaxial resonator RD in FIG. 6(*c*), the equipment connecting side electrodes 11*g* and 11*h* are adapted to respectively confront the inner conductor side electrodes 12*g* and 12*h* in a relation parallel to each other. In the coaxial resonator RE in FIG. 6(*d*), the lead-out electrodes 12*a* and 12*b* in FIG. 2 are dispensed with, and the coupling capacity for the capacitor electrodes 9*i* and 9*j* is achieved between the inner conductors 4*a* and 4*b* and the equipment connecting side electrodes 11*i* and 11*j*, which have an annular form surrounding the inner conductors 4*a* and 4*b* and the through-bores 3*a* and 3*b*.

Figure 7:
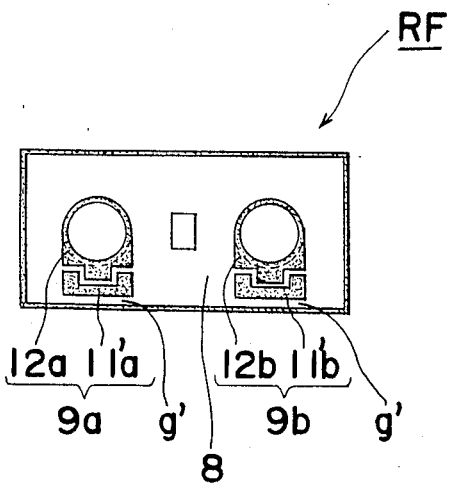
FIG. 7 is a top plan view of a coaxial resonator of the present invention showing a modification of a positional relation between capacitor electrodes and ground fault prevention gaps, FIGS. 8(*a*) and 8(*b*) are fragmentary side elevational views showing modifications of connections between capacitor electrodes and input and output side strip lines.

As shown in another modified coaxial resonator RF in FIG. 7, illustrating a variation in the positional relation between the capacitor electrodes 9*a* and 9*b* and the ground fault prevention gap, the gap g described as provided along the upper side edge of the coaxial resonator RA (FIGS. 3 and 4) may be replaced by gaps g′ provided on the upper open end face 8 between the equipment connecting side electrodes 11′*a* and 11′*b* and the corresponding side edge of the open end face 8.

Figure 8A:
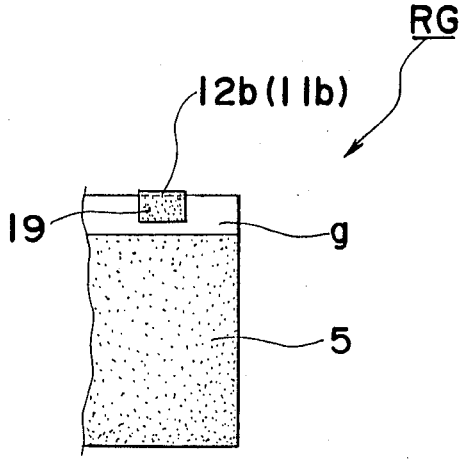
Figure 8B:
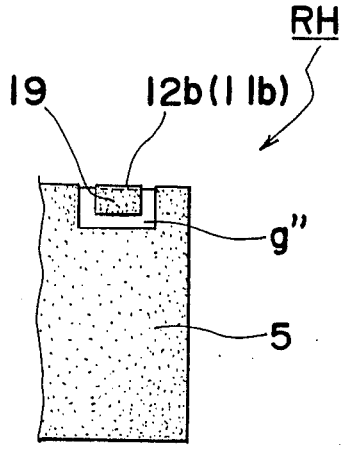

Referring to FIGS. 8(*a*) and 8(*b*), there are shown further modified coaxial resonators RG and RH which are arranged to improve reliability in the connection between the capacitor electrodes 9*a* and 9*b* and the corresponding input and output side strip lines 16 and 17 when the resonator is mounted on its side on the printed circuit board 14 of the electronic apparatus (FIG. 5).

In the modified resonator RG of FIG. 8(*a*), soldering electrodes 19 connected for electrical conduction with the equipment connecting side electrodes 11*a* and 11*b* are disposed on the ground fault prevention gap g provided on the side wall between the electrodes 11*a* and 11*b* and the outer conductor 5. Alternatively, in the coaxial resonator RH in FIG. 8(*b*), the gap g is modified into U-shaped gaps g″ each surrounding the soldering electrodes 19 through proper intervals as illustrated.

Figure 9:
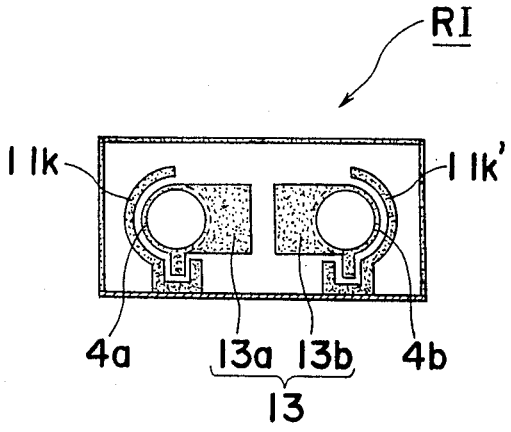
FIG. 9 is a top plan view showing a modification of a coupling means.

FIG. 9 shows a coaxial resonator RI which includes a modification of the coupling degree adjusting bore 13, which is the coupling means for the first and second single resonator units 1*a* and 1*b*. In FIG. 9 the coupling degree adjusting bore 13 is replaced by capacitor electrodes or inner conductor connecting side electrodes 13*a* and 13*b* connected for conduction with the inner conductors 4*a* and 4*b* and disposed to face each other between the inner conductors 4*a* and 4*b* and to confront the corresponding equipment connecting side electrodes 11*k* and 11*k*′ through proper intervals as shown.

Figure 10:
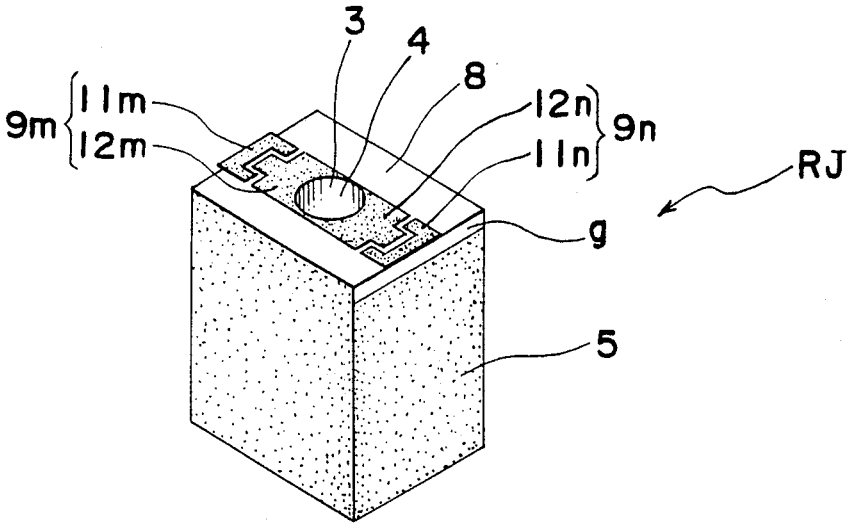
FIG. 10 is a perspective view of a coaxial resonator according to a second embodiment of the present invention.

Referring to FIG. 10, there is shown a single coaxial resonator RJ of a $\frac{1}{4}$ wavelength type according to a second embodiment of the present invention. The coaxial resonator RJ includes a pair of capacitor electrodes 9*m* and 9*n* provided laterally at left and right sides of the upper end of the through-bore 3 on the open end face 8 of the dielectric material block. The capacitor electrodes 9*m* and 9*n* respectively have the inner conductor side electrodes 12*m* and 12*n* connected for conduction with the inner conductor 4 and the equipment connecting side electrodes 11*m* and 11*n* confronting the electrodes 12*m* and 12*n* through predetermined intervals, with the ground fault prevention gaps g being respectively formed between the electrodes 11*m* and 11*n* and the outer conductor 5.

Figure 11:
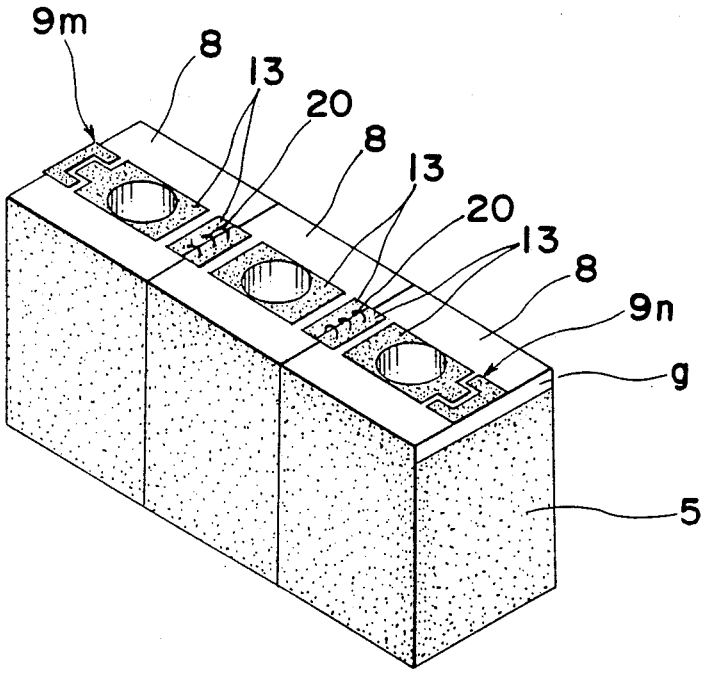
FIG. 11 is a perspective view showing a third embodiment according to the present invention.

Referring further to FIG. 11, there is illustrated a three-staged electrical filter device of a $\frac{1}{4}$ wavelength type, which includes three coaxial resonators, for example, resonators RJ in FIG. 10, connected to each other at corresponding side walls thereof by soldering, silver paint baking or glass brazing, etc., while the neighboring equipment connecting side electrodes 11 of the respective single resonator units are further connected to each other by a connecting means 20 such as wire bonders, ribbon bonders or ribbon solders, etc. In the above filter device, the capacitor electrodes 9*m* and 9*n* at the opposite ends, i.e. capacitor electrodes at the input and output sides, have a larger capacity, and the intermediate capacitor electrodes provided therebetween are adapted to function as the coupling means 13.

It is needless to say that the number of stages of the electrical filter is not limited to the three stages as in the above embodiment, but may be increased as needed, and an electrical filter of more than three stages may be constituted through connection by the coupling means 13 in the manner as stated above.

It should be noted here that in the foregoing embodiments, although the present invention has been described with reference to the coaxial resonators having a rectangular cross section, the application of the present invention is not limited to such rectangular resonators alone, but may be readily applied to cylindrical resonators in which the dielectric material blocks are formed into a cylindrical configuration.

As is clear from the foregoing description, according to the present invention, since it is so arranged that the capacitor electrodes are formed on the open end face of the dielectric material block, such capacitor electrodes may be directly attached to the printed circuit board or the like of an electronic apparatus so as to also serve as the connecting terminals. Thus, the resonators may be used as filter devices, as they do not require any of the fittings conventionally required such as pin terminals, metallic cases, spring members, etc. Therefore, the cost necessary for the material and assembling of such fittings is completely eliminated, with the assembling work of the resonator onto the printed circuit board, etc. being markedly simplified for acceleration of automation of such work, while the material cost and assembling cost may be reduced by the omission of the parts as described above. Moreover, since there is almost no possibility that the capacitor electrodes will be damaged or separated even at high temperatures or under the circumstances of large temperature variations, and excessive noises, the resonator can stably function even under unfavorable conditions, with a consequent improvement of reliability during use.

Furthermore, if the single resonator units having the features described above are coupled to each other through coupling means, coaxial resonators in multistages may be readily manufactured without impairing the effects described above.

Although embodiments of the present invention have been described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. A dielectric coaxial resonator assembly comprising:

a circuit board having thereon a signal conductor and a ground conductor;

a block member formed of a dielectric material and having an axial through opening formed therein extending from first to second opposite end faces of said block member;

an inner conductive layer formed on an inner peripheral surface of said through opening;

an outer conductive layer spaced from said inner conductive layer by said dielectric material and formed on at least one lateral side surface of said block member, said outer conductive layer being directly connected to said ground conductor on said circuit board; and capacitor electrodes on said second end face of said block member and extending from adjacent said inner conductive layer to said at least one lateral side surface, said capacitor electrodes being directly connected to said signal conductor on said circuit board and providing a coupling capacity which enables an external signal from said signal conductor to be capacitively coupled to said inner conductive layer.

2. A coaxial resonator as claimed in claim 1, wherein said capacitor electrodes include (a) an inner conductor side electrode conductively connected to said inner conductive layer, and (b) an equipment connecting side electrode disposed on said second end face adjacent said inner conductor side electrode and extending to said at least one lateral side surface, and being directly connected to said signal conductor, said equipment connecting side electrode being spaced from said inner conductor side electrode to provide therewith said coupling capacity, and said equipment connecting side electrode and said outer conductive layer being spaced apart to provide a ground fault prevention gap between said equipment connecting side electrode and said outer conductive layer.

3. A coaxial resonator as in claim 2, wherein said inner conductor side electrode and equipment connecting side electrode are spaced so as to confront each other across a narrow U-shaped electrode coupling gap, thereby providing a selected degree of coupling capacity.

4. A coaxial resonator as in claim 2, wherein said two electrodes are spaced so as to confront each other across a narrow annular electrode coupling gap, thereby providing a selected degree of coupling capacity.

5. A coaxial resonator as in claim 1, further comprising:

an end face conductive layer formed on said first end face and providing a conductive path between said inner and outer conductive layers.

6. An assembly in claim 1, further comprising conductive bonding means for forming electrical connections between said outer conductive layer and said ground conductor, and forming electrical connections between said capacitor electrodes and said signal conductor, said conductive bonding means providing substantially the only such electrical connections.

7. A multi-stage filter assembly comprising:

(A) a circuit board having thereon at least two signal conductors and a ground conductor;

(B) first and second dielectric coaxial resonators, each said resonator including:

(1) a block member formed of a dielectric material and having an axial through opening formed therein extending from first to second opposite end faces of said block member;

(2) an inner conductive layer formed on an inner peripheral surface of said through opening;

(3) an outer conductive layer spaced from said inner conductive layer by said dielectric material and formed on at least a first lateral side surface of said block member, said outer conductive layer being directly connected to said ground conductor on said circuit board; and (4) capacitor electrodes on said second end face of said block member and extending from adjacent said inner conductive layer to said first side surface, said capacitor electrodes being directly connected to a respective one of said signal conductors on said circuit board and providing a coupling capacity which enables signals to be capacitively coupled between said signal conductors and said respective inner conductive layers; and (C) said first and second coaxial resonators being connected to each other at respective second side surfaces thereof which are adjacent said first side surfaces.

8. A multi-staged filter device as in claim 7, wherein each of said first and second resonators further includes an end face conductive layer formed on said first end face and providing a conductive path between said inner and outer conductive layers.

9. An assembly as in claim 7, further comprising conductive bonding means for forming electrical connections between each said outer conductive layer and said ground conductor, and forming electrical connections between each of said capacitor electrodes and said respective one of said signal conductors, said conductive bonding means providing substantially the only such electrical connections.

10. A dielectric coaxial resonator assembly comprising:

a circuit board having thereon at least two signal conductors and a ground conductor;

a block member formed of a dielectric material and having first and second axial through openings formed therein and extending from first to second opposite end faces of said block member;

first and second inner conductive layers formed on respective inner peripheral surfaces of said first and second through openings, respectively;

an outer conductive layer spaced from said first and second inner conductive layers by said dielectric material and formed on at least a first lateral side surface of said block member, said outer conductive layer being directly connected to said ground conductor on said circuit board;

first and second capacitor electrodes on said second end face of said block member and extending from adjacent said first and second inner conductive layers, respectively to said first side surface, said first and second capacitor electrodes being directly connected to respective said signal conductors on said circuit board and providing respective coupling capacities which enable signals to be capacitively coupled between said signal conductors and said first and second inner conductive layers, respectively; and coupling means provided in said dielectric material block member in an area located between said first and second through openings.

11. A dielectric material coaxial resonator as claimed in claim 10, wherein each of said first and second capacitor electrodes includes (a) an inner conductor side electrode conductively connected to a respective one of said first and second inner conductive layers, and (b) an equipment connecting side electrode disposed on said second end face adjacent said inner conductor side electrode and extending to said first side surface and being directly connected to respective said signal conductors;

in each of said first and second capacitor electrodes, said equipment connecting side electrodes being spaced from said inner conductor side electrodes to provide therewith such respective coupling capacities; and said equipment connecting side electrodes and said outer conductive layer being spaced apart to provide a ground fault prevention gap between said equipment connecting side electrodes and said outer conductive layer.

12. A dielectric material coaxial resonator as claimed in claim 11, wherein said equipment connecting side electrodes are provided with soldering electrodes electrically connected thereto and to be directly connected to said respective signal conductors on said circuit board and disposed on said ground fault prevention gap.

13. A dielectric material coaxial resonator as claimed in claim 10, wherein said coupling means is a gap formed in said dielectric material block member at a location intermediate said first and second through openings and extending into said block member to adjust the electrostatic coupling between said first and second inner conductive layers.

14. A dielectric material coaxial resonator as claimed in claim 10, wherein each one of said first and second capacitor electrodes includes (a) an inner conductor side electrode conductively connected to a respective one of said first and second inner conductive layers, said inner conductor side electrodes being spaced apart by a selected spacing interval so as to serve as a coupling means providing a selected degree of resonator coupling capacity between said first and second inner conductive layers, and (b) a corresponding equipment connecting side electrode disposed on said second end face adjacent said inner conductor side electrode and spaced therefrom to provide therewith such respective signal coupling capacities.

15. A dielectric coaxial resonator as in claim 10, further comprising an end face conductive layer formed on said first end face and providing a conductive path between said inner and outer conductive layers.

16. An assembly as in claim 10, further comprising conductive bonding means for forming electrical connections between said outer conductive layer and said ground conductor, and forming electrical connections between each of said first and second capacitor electrodes and said respective signal conductors, said conductive bonding means providing substantially the only such electrical connections.

17. An assembly as in claim 6, claim 9, or claim 16, wherein said conductive bonding means comprises solder.

18. An assembly as in claim 6, claim 9, or claim 16, wherein said conductive bonding means comprises an electrically conductive paste material.

19. A dielectric coaxial resonator adapted for connection to a circuit board, comprising:

(1) a block member formed of a dielectric material and having an axial through opening formed therein extending from first to second opposite end faces of said block member;

(2) an inner conductive layer formed on an inner peripheral surface of said through opening;

(3) an outer conductive layer spaced from said inner conductive layer by said dielectric material and formed on at least one lateral side surface of said block member for direct connection to a ground conductor on such circuit board; and (4) capacitor electrodes on said second end face of said block member, said capacitor electrodes including (a) an inner conductor side electrode conductively connected to said inner conductive layer, and (b) an equipment connecting side electrode disposed on said second end face adjacent said inner conductor side electrode and extending to said at least one lateral side surface for direct connection to a signal conductor on such circuit board, (c) said equipment connecting side electrode being spaced from said inner conductor side electrode to provide therewith a coupling capacity which enables an external signal from such signal conductor to be capacitively coupled to said inner conductive layer.

(d) said equipment connecting side electrode and said outer conductive layer being spaced apart to provide a ground fault prevention gap between said equipment connecting side electrode and said outer conductive layer;

(5) said equipment connecting side electrode disposed on said second end face further extending therefrom onto said at least one lateral side surface.

20. A dielectric coaxial resonator adapted for connection to a circuit board, comprising:

(1) a block member formed of a dielectric material and having an axial through opening formed therein extending from first to second opposite end faces of said block member;

(2) an inner conductive layer formed on an inner peripheral surface of said through opening;

(3) an outer conductive layer spaced from said inner conductive layer by said dielectric material and formed on at least one lateral side surface of said block member for direct connection to a ground conductor on such circuit board; and (4) capacitor electrodes on said second end face of said block member, said capacitor electrodes including (a) an inner conductor side electrode conductively connected to said inner conductive layer, and (b) an equipment connecting side electrode disposed on said second end face adjacent said inner conductor side electrode and extending to said at least one lateral side surface for direct connection to a signal conductor on such circuit board, (c) said equipment connecting side electrode being spaced from said inner conductor side electrode to provide therewith a coupling capacity which enables an external signal from such signal conductor to be capacitively coupled to said inner conductive layer, and (d) said equipment connecting side electrode and said outer conductive layer being spaced apart to provide a ground fault prevention gap between said equipment connecting side electrode and said outer conductive layer;

(5) said inner conductor side electrode and equipment connecting side eletrode being spaced so as to confront each other across a narrow linear electrode coupling gap, thereby providing a selected degree of coupling capacity.

21. A dielectric coaxial resonator adapted for connection to a circuit board, comprising:

(1) a block member formed of a dielectric material and having an axial-through opening formed therein extending from first to second opposite end faces of said block member;

(2) an inner conductive layer formed on an inner peripheral surface of said through opening;

(3) an outer conductive layer spaced from said inner conductive layer by said dielectric material and formed on at least one lateral side surface of said block member for direct connection to a ground conductor on such circuit board; and (4) capacitor electrodes on said second end face of said block member, said capacitor electrodes including (a) an inner conductor side electrode conductively connected to said inner conductive layer, and (b) an equipment connecting side electrode disposed on said second end face adjacent said inner conductor side electrode and extending to said at least one lateral side surface for direct connection to a signal conductor on such circuit board, (c) said equipment connecting side electrode being spaced from said inner conductor side electrode to provide therewith a coupling capacity which enables an external signal from such signal conductor to be capacitively coupled to said inner conductive layer, and (d) said equipment connecting side electrode and said outer conductive layer being spaced apart to provide a ground fault prevention gap between said equipment connecting sade electrode and said outer conductive layer;

(5) said inner conductor side electrode and equipment connecting side electrode having respective finger means which are interleaved so as to confront each other across a narrow U-shaped electrode coupling gap, thereby providing a selected degree of coupling capacity.

* * * * *